US010889136B2

(12) United States Patent
Kunioka et al.

(10) Patent No.: US 10,889,136 B2
(45) Date of Patent: Jan. 12, 2021

(54) PRINTING TARGET HOLDER, PRINTER, HEATER, IMAGE FORMING SYSTEM, AND RECORDING MEDIUM

(71) Applicants: Satoshi Kunioka, Kanagawa (JP); Kazuyoshi Matsumoto, Tokyo (JP); Masaharu Ohtani, Kanagawa (JP)

(72) Inventors: Satoshi Kunioka, Kanagawa (JP); Kazuyoshi Matsumoto, Tokyo (JP); Masaharu Ohtani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/545,880

(22) Filed: Aug. 20, 2019

(65) Prior Publication Data

US 2020/0101769 A1 Apr. 2, 2020

(30) Foreign Application Priority Data

Sep. 28, 2018 (JP) ..... 2018-183507

(51) Int. Cl.

| | |
|---|---|
| ***B41J 11/00*** | (2006.01) |
| ***B41J 11/02*** | (2006.01) |
| ***B41J 3/407*** | (2006.01) |
| ***B41J 11/06*** | (2006.01) |

(52) U.S. Cl.

CPC ..... *B41J 11/02* (2013.01); *B41J 3/4078* (2013.01); *B41J 11/002* (2013.01); *B41J 11/06* (2013.01)

(58) Field of Classification Search

CPC ... B41J 2/01; B41J 11/002; B41J 11/02; B41J 11/06; B41J 3/4078; D06B 19/00

See application file for complete search history.

(56) References Cited

U.S. PATENT DOCUMENTS

| | | | | |
|---|---|---|---|---|
| 5,948,728 | A * | 9/1999 | Patton | B41M 1/34 156/235 |
| 9,211,735 | B2 * | 12/2015 | Yangishita | B41J 11/02 |
| 2003/0079638 | A1 * | 5/2003 | Burnett | B41M 5/035 101/492 |
| 2004/0179081 | A1 * | 9/2004 | Nimi | B41J 2/01 347/104 |
| 2007/0103529 | A1 * | 5/2007 | Pearl | D06P 1/65125 347/101 |
| 2018/0147858 | A1 | 5/2018 | Kunioka | |
| 2018/0217536 | A1 | 8/2018 | Obata et al. | |
| 2018/0345691 | A1 | 12/2018 | Kunioka | |

FOREIGN PATENT DOCUMENTS

| | | |
|---|---|---|
| JP | 2006-093923 | 4/2006 |
| JP | 2007-202681 | 8/2007 |
| JP | 2010-061275 | 3/2010 |
| JP | 2013-022858 | 2/2013 |
| JP | 2013-096017 | 5/2013 |
| JP | 2016-020550 | 2/2016 |
| JP | 2018-084013 | 5/2018 |
| JP | 2018-087396 | 6/2018 |
| JP | 2018-090942 | 6/2018 |

* cited by examiner

*Primary Examiner* — Anh T Vo
(74) *Attorney, Agent, or Firm* — Duft & Bornsen, PC

(57) ABSTRACT

A printing target holder includes a platen to hold a printing target portion of a printing target to which printing is applied, and the platen is configured to hold the printing target in a flat state. The platen includes a support face disposed on a top side of the platen and configured to support the printing target portion of the printing target; and an escape portion lower in height than the support face.

13 Claims, 17 Drawing Sheets

PRINTING TARGET HOLDER, PRINTER, HEATER, IMAGE FORMING SYSTEM, AND RECORDING MEDIUM

CROSS-REFERENCE TO RELATED APPLICATION

This patent application is based on and claims priority pursuant to 35 U.S.C. § 119(a) to Japanese Patent Application No. 2018-183507, filed on Sep. 28, 2018, in the Japan Patent Office, the entire disclosure of which is hereby incorporated by reference herein.

BACKGROUND

Technical Field

The present disclosure relates to a printing target holder, a printer, a heater, an image forming system, and a recording medium.

Description of the Related Art

Conventionally, the following structure is known to hold a fabric. For example, a fabric holder includes a base, a platen to hold a portion of the fabric in which printing is made in a flat state, and an outer cover. The outer cover sandwiches the fabric with a peripheral portion of the platen. Between the platen and the base, an accommodation space is formed to accommodate a surplus portion of the fabric.

SUMMARY

According to an embodiment of this disclosure, a printing target holder includes a platen to hold a printing target portion of a printing target to which printing is applied, and the platen is configured to hold the printing target in a flat state. The platen includes a support face disposed on a top side of the platen and configured to support the printing target portion of the printing target; and an escape portion lower in height than the support face.

According to another embodiment, a printer includes a mount on which the printing target holder described above is removably mounted, and a printing device configured to print an image on the printing target held by the printing target holder.

According to another embodiment, a heater includes a mount configured to removably accommodate the printing target holder described above, and a heating element configured to heat the printing target held by the printing target holder.

According to another embodiment, an image forming system includes the printing target holder, the printer, and the heater described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
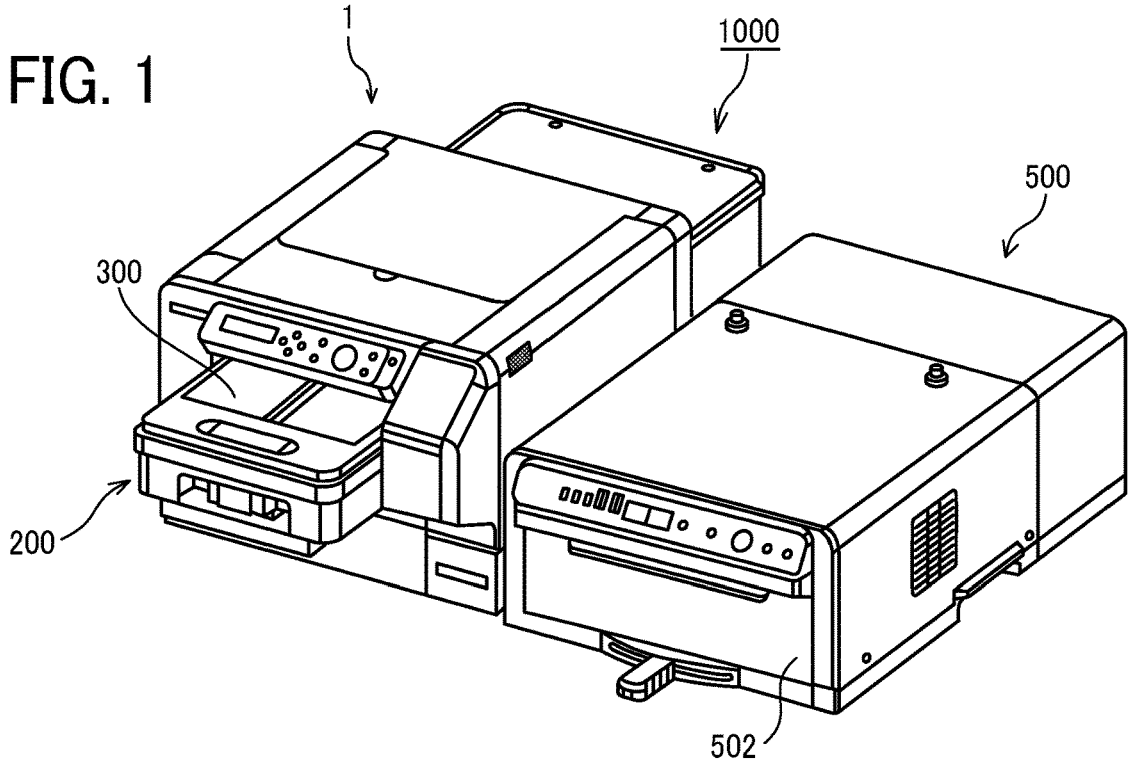
FIG. 1 is a perspective view illustrating an example of usage of an image forming apparatus according to Embodiment 1 of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

Descriptions are given below of an image forming system according to Embodiment 1 of the present disclosure with reference to FIG. 1. FIG. 1 is a perspective view of the image forming system and illustrates one example of usage of the image forming system.

An image forming system 1000 (an image applying system) includes a cassette 200 as a printing target holder (a fabric holder in the present embodiment), a printer 1, and a heater 500. The cassette 200 is attachable to and detachable from the printer 1. The printer 1 prints an image on a cloth, serving as a printing target (or a printing medium) held in the cassette 200. In the example described here, a pair of socks 400 (see FIGS. 8A and 8B) is the printing target. The heater 500 can removably accommodate the cassette 200. The heater 500 accommodates the cassette 200 holding the socks 400 and heats the socks 400 to fix an image on the socks 400.

The printer 1 and the heater 500 of the image forming system 1000 are separate from each other. For example, the printer 1 is disposed on a side of the heater 500. Alternatively, the printer 1 and the heater 500 may be stacked one on the other. Yet alternatively, the printer 1 can be disposed away from the heater 500. When the printer 1 and the heater 500 are stacked one on the other, the installation area occupied by the printer 1 and the heater 500 can be reduced.

To form an image on the sock 400 by the image forming system 1000, a user sets (mounts) the cassette 200 holding the sock 400 in the printer 1 and prints the image on the sock 400 with the printer 1.

When the printing of the image on the sock 400 by the printer 1 is completed, the cassette 200 holding the sock 400 is removed from the printer 1. Then, the user opens a front door 502 (a front cover) of the heater 500, sets the cassette 200 holding the printed sock 400 in the heater 500, and closes the front door 502. The heater 500 heats the entire cassette 200 together with the sock 400. The image printed on the sock 400 is fixed on the sock 400 as the sock 400 is heated.

Thus, the cassette 200 which is a printing target holder can be shared by both the printer 1 and the heater 500. Accordingly, the user can set, inside the heater 500, the cassette 200 with the sock 400 held in the state at the printing. This feature can prevent crease or overlapping of the sock 400 caused in transport of the sock 400 and accordingly prevent disturbance of the image on the sock 400 due to such creasing or overlapping. Thus, workability in image formation on the sock 400 can improve.

Figure 2:
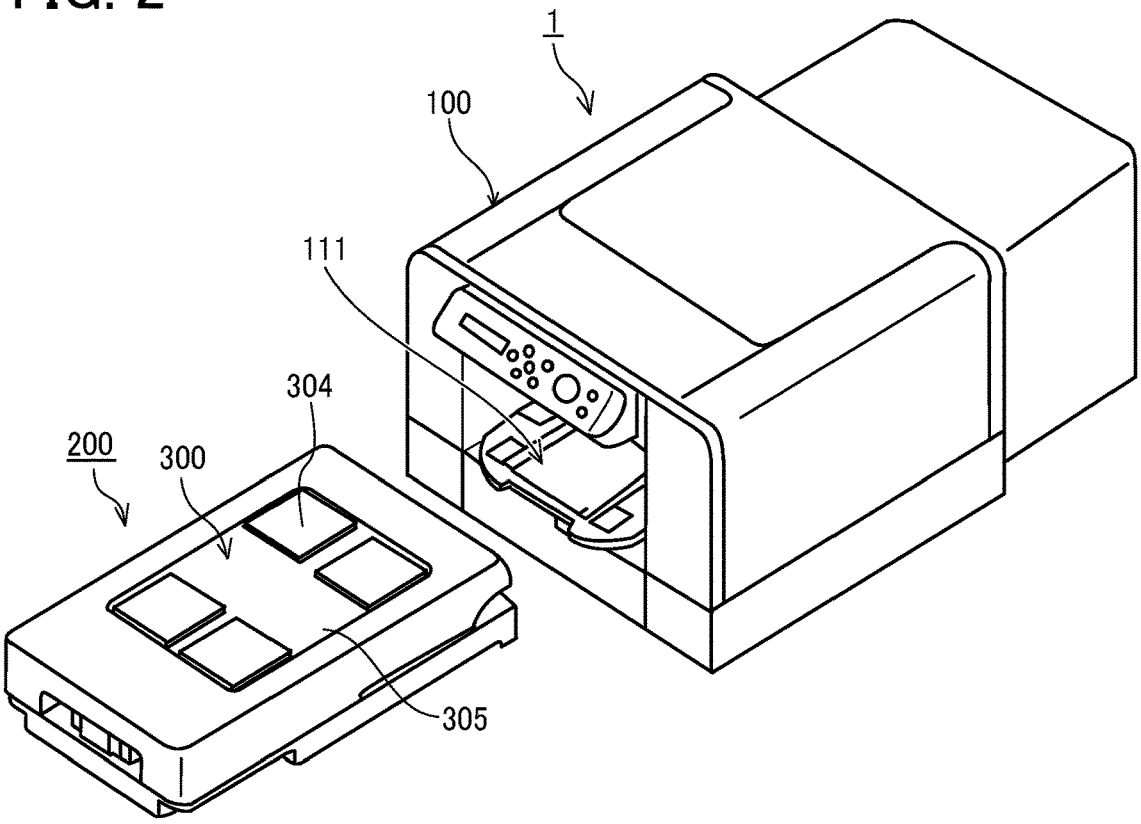
FIG. 2 is an exterior perspective view of an example of a printer according to Embodiment 1, with a cassette pulled out.
Figure 3:
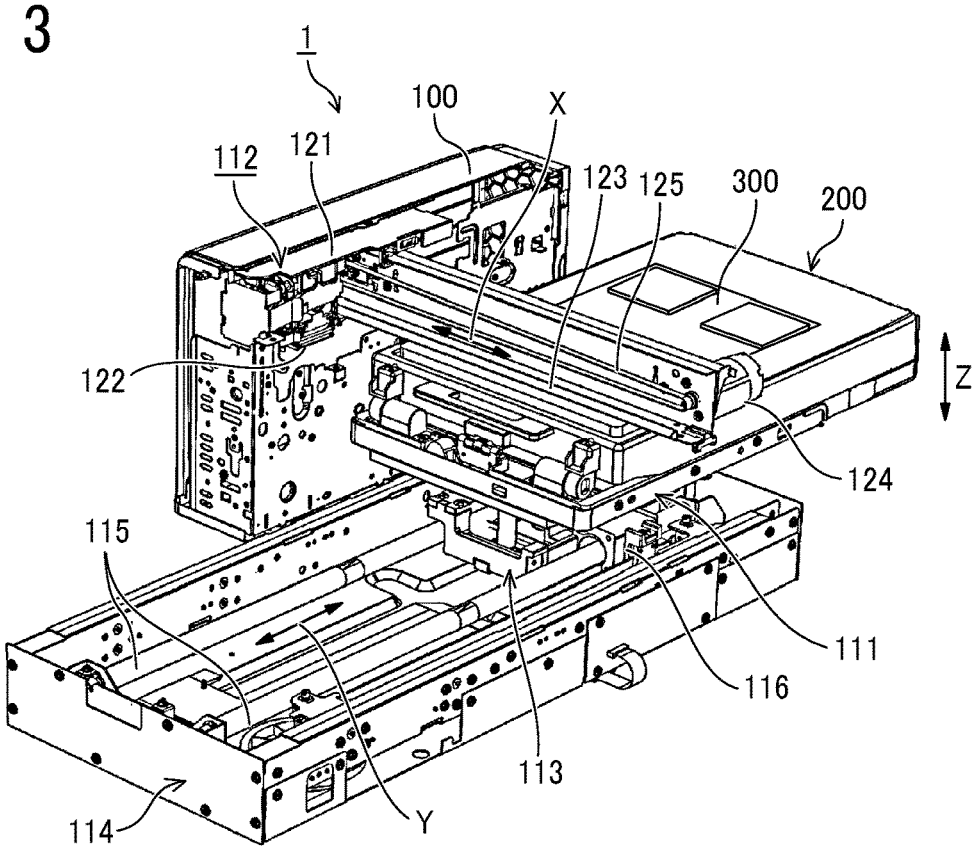
FIG. 3 is a perspective view illustrating an entire configuration of a mechanical section of the printer illustrated in FIG. 2.
Figure 4:
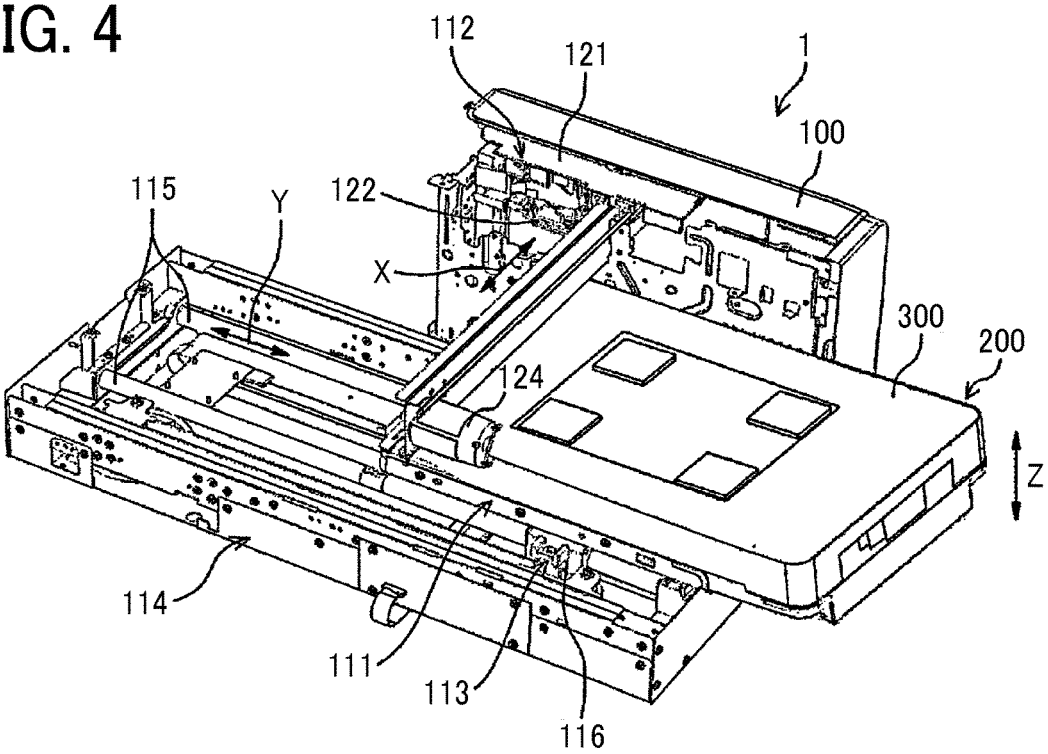
FIG. 4 is a perspective view of the printer as seen from a side different from a side illustrated in FIG. 3.

Next, an example of the printer is described with reference to FIGS. 2 to 4. FIG. 2 is an exterior perspective view of the printer with the cassette pulled out, FIG. 3 is a perspective view illustrating an entire configuration of a mechanical section of the printer, and FIG. 4 is a perspective view of the printer as seen from a side different from a side illustrated in FIG. 3.

A printer body 100 of the printer 1 includes a stage 111 and a printing device 112. The stage 111 serves as a mount (a receiver) that removably holds the cassette 200 and moves back and forth. In the cassette 200, the sock 400 (the cloth) being the printing target is set. The printing device 112 prints an image on the sock 400 placed in the cassette 200 held by the stage 111.

The stage 111 is disposed on a conveyance structure 113. The conveyance structure 113 is held so as to be movable in a direction (feed direction) indicated by arrow Y (hereinafter, direction Y) with respect to the printer body 100.

Conveyance guides 115 are disposed, along the direction Y, in a bottom casing 114 of the printer body 100. The conveyance guides 115 hold slider portions 116 of the conveyance structure 113 movably.

The printing device 112 includes a carriage 121 and the head 122. The carriage 121 is movable in a direction (main scanning direction) indicated by arrow X (hereinafter, direction X) with respect to the stage 111. The head 122 is mounted on the carriage 121.

The carriage 121 is movably held by a guide 123 disposed along the direction X. A driving motor 124 moves the carriage 121 back and forth in the direction X via a scanning assembly, such as a timing belt 125. In this example, the head 122 is a liquid discharge head to discharge ink onto a surface of a cloth to form an image. However, examples of the head are not limited to the liquid discharge head but may be any other suitable type of head.

In the printer 1, with the sock 400 set on the platen 300 of the cassette 200, the cassette 200 is mounted and held on the stage 111 inside the printer body 100. As the movement of the stage 111 in the direction Y and the reciprocal movement of the head 122 in the direction X are repeated, the head 122 prints a desired image on the sock 400.

In this case, the stage 111 can be moved up and down in the direction indicated by arrow Z (hereinafter, direction Z). By moving the stage 111 up and down according to the thickness of the sock 400, the gap between the sock 400 and the head 122 can be adjusted. In addition, the printing device 112 can also be made movable up and down.

Figure 5:
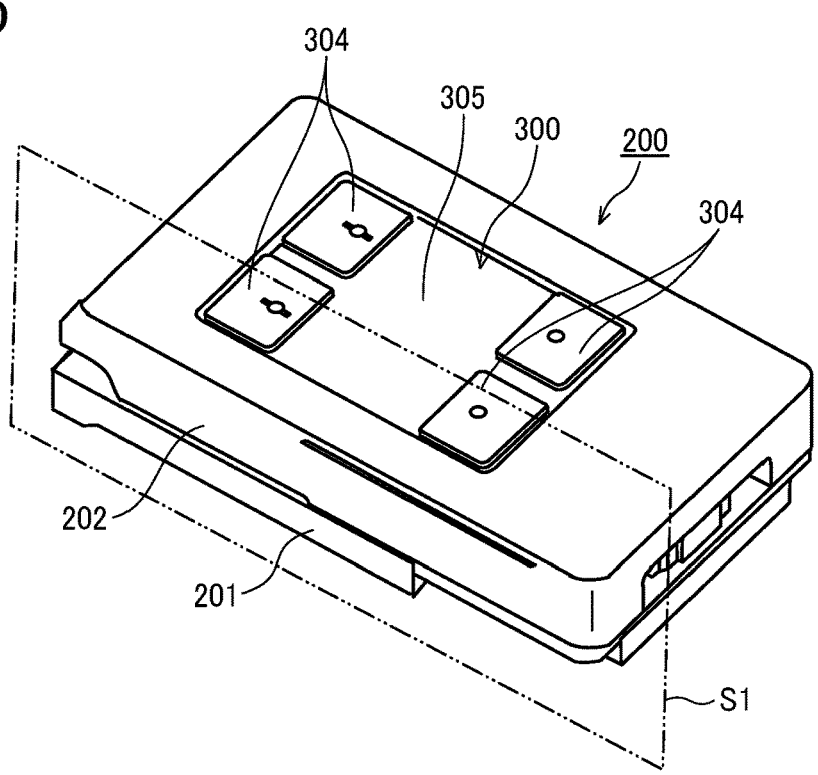
FIG. 5 is a perspective view of a cassette according to Embodiment 1 of the present disclosure.
Figure 6:
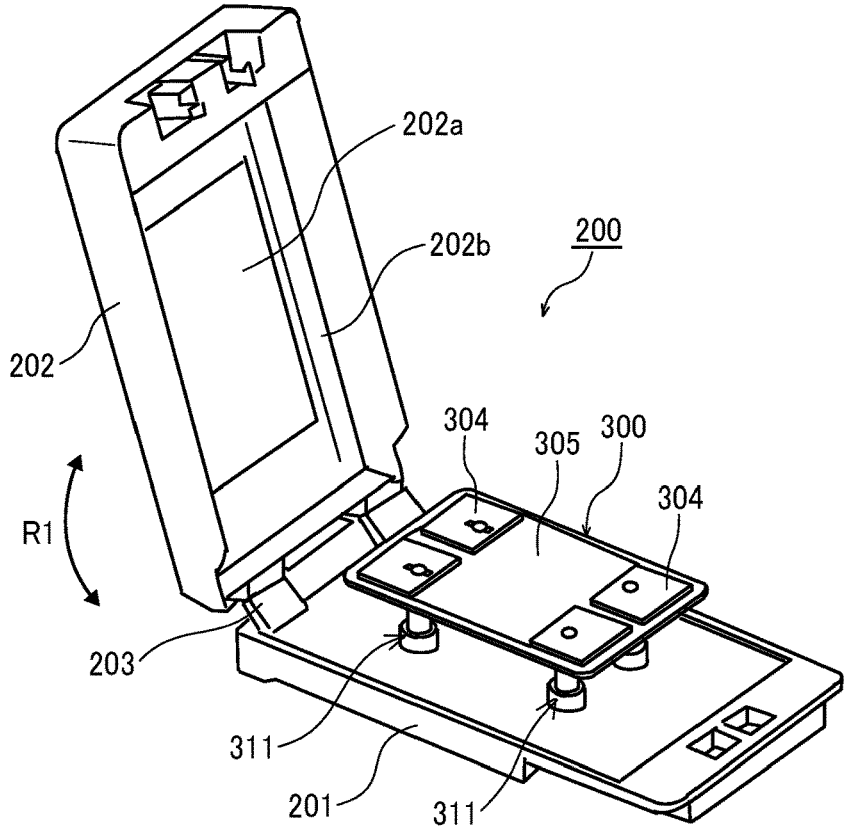
FIG. 6 is a perspective view illustrating a state in which an outer cover of the cassette illustrated in FIG. 5 is opened.
Figure 7:
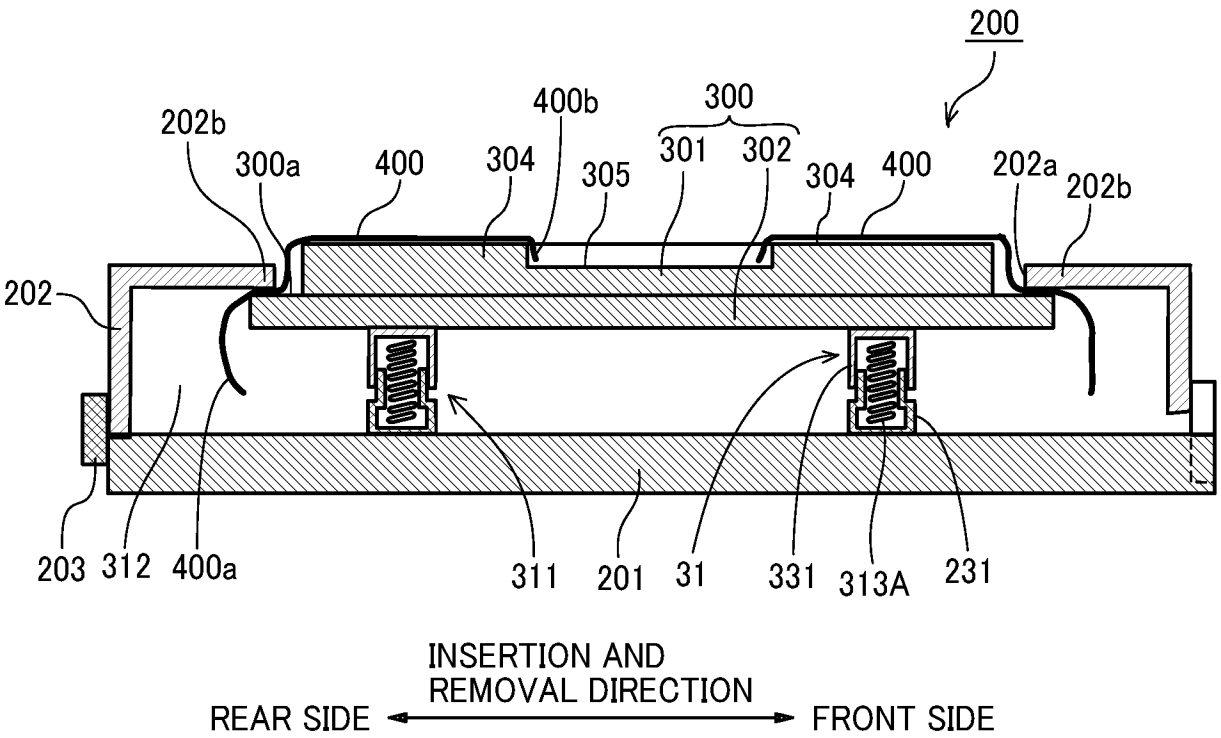
FIG. 7 is a schematic cross-sectional view illustrating a different state of the cassette cut along a longitudinal direction of the cassette corresponding to a cross section on a plane S1 in FIG. 5.

Next, the cassette as the printing target holder according to Embodiment 1 of the present disclosure will be described with reference to FIGS. 5 to 7. FIG. 5 is a perspective view of the cassette. FIG. 6 is a perspective view of the cassette in a state in which an outer cover is opened. FIG. 7 is a schematic cross-sectional view illustrating a different state of the cassette cut along a longitudinal direction of the cassette corresponding to a cross section on a plane S1 in FIG. 5.

The cassette 200 includes a base 201 and a platen 300 that holds a portion of the sock 400 to be printed in a flat state.

As illustrated in FIG. 7, the platen 300 is constructed of a heat insulator 301 and a platen structure 302. The heat insulator 301 serves as a support face that supports the printing target in a flat state. The heat insulator 301 is resistant against heat generated by the heater 500 described below.

A top face of the platen 300 includes a projecting portion 304 serving as a support face and a recess 305 serving as an escape portion. The height of the projecting portion 304 is higher than the height (at a bottom face) of the recess 305.

The top face of the projecting portion 304 is used as the support face to support the sock 400 being the printing target in a flat state. The sock 400 includes a surplus portion 400*b* where the printing is not performed, and the recess 305 is used as a clearance (an escape portion) for letting a surplus portion 400*b* to escape. That is, in the present embodiment, the top face of the platen 300 includes an escape portion lower in height than the support face that supports the sock 400, and the escape portion is a recess for releasing the surplus portion 400*b* in which printing is not performed.

In the present embodiment, the projecting portions 304 are respectively disposed at both ends (the rear side and the front side) in the direction in which the cassette 200 is inserted to or removed from the printer 1 or the heater 500 (i.e., insertion and removal direction). The recess 305 is disposed in a center portion in the insertion and removal direction. With this configuration, two socks 400 (one pair of socks 400) can be set in the cassette 200 so that printing thereon can be performed at a time.

In addition, the clearance between the projecting portions 304 is a guide for the center of the cassette 200 in the direction orthogonal to the insertion and removal direction of the cassette 200.

One end portion of an outer cover 202 is hinged to the base 201 by a hinge 203. The outer cover 202 is openable and closable in the direction indicated by arrow R1 relative to the base 201.

The outer cover 202 includes a frame portion 202*b* that has an opening 202*a* at a position to oppose the platen 300. The platen 300 of the cassette 200 includes a flange portion 300*a* (see FIG. 7) as a periphery portion. The outer cover 202 holds the sock 400 between the frame portion 202*b* and the flange portion 300*a* of the platen 300.

The cassette 200 includes supports 311 standing on the base 201 to support the platen 300. With this structure, the platen 300 and the base 201 define an accommodation space 312 to accommodate a surplus portion 400*a* of the sock 400.

The platen 300 is supported on the base 201 by the supports 311. The supports 311 are respectively disposed on the front side and the rear side of the cassette 200 in the insertion and removal direction with respect to the printer 1. In the direction orthogonal to the insertion and removal direction of the cassette 200 from the printer 1, two supports 311 are arranged.

The support 311 includes a hollow column 231 on the base 201 side, a hollow column 331 on the platen 300 side, and a compression spring 313A between the hollow column 231 and the hollow column 331. The hollow column 331 is movably fitted with the hollow column 231.

Figure 8A:
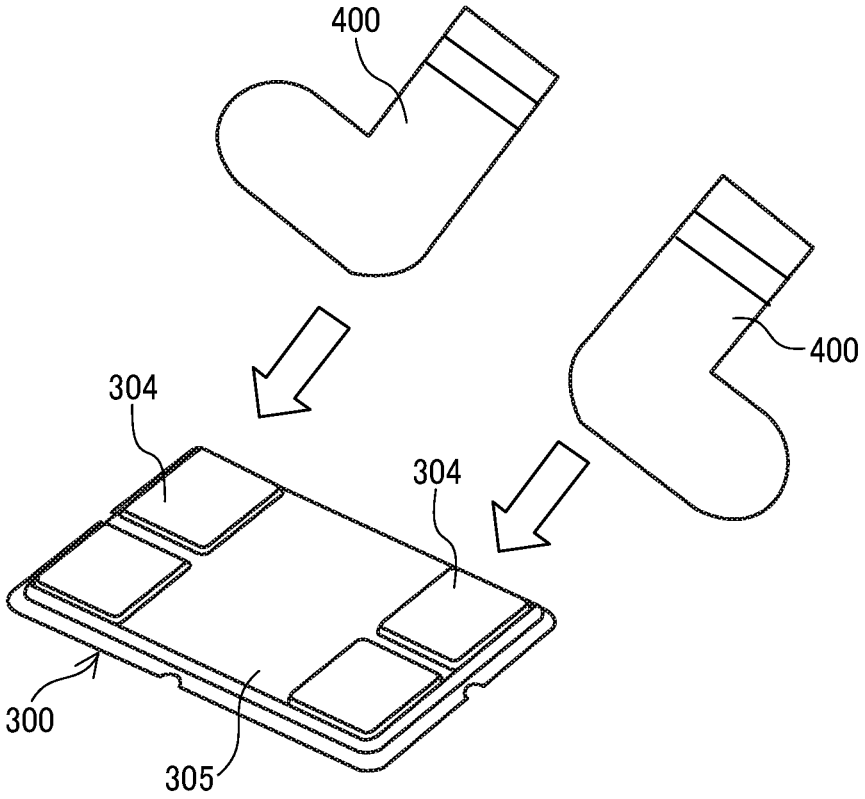
FIGS. 8A and 8B are explanatory view illustrating setting of socks in the cassette according to Embodiment 1.
Figure 8B:
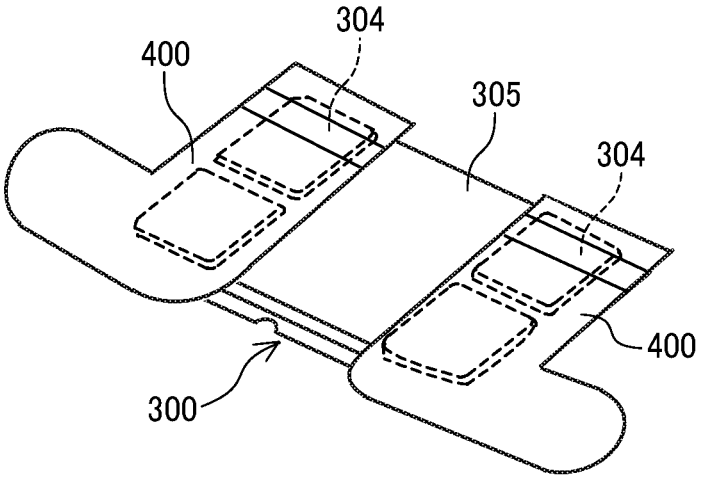

Next, the setting of the sock 400 in the cassette 200 will be described with reference to FIGS. 8A, 8B, and 9 as well. FIGS. 8A and 8B are explanatory view illustrating setting of socks on the platen, and FIG. 9 is a perspective view of the cassette illustrating a state in which the outer cover is closed.

To set the socks 400 on the platen 300 of the cassette 200, the outer cover 202 is opened as illustrated in FIG. 6. Then, as illustrated in FIGS. 8A and 8B, one sock 400 is placed on the projecting portions 304 on the rear side, and the other sock 400 is placed on the projecting portions 304 on the front side.

Figure 9:
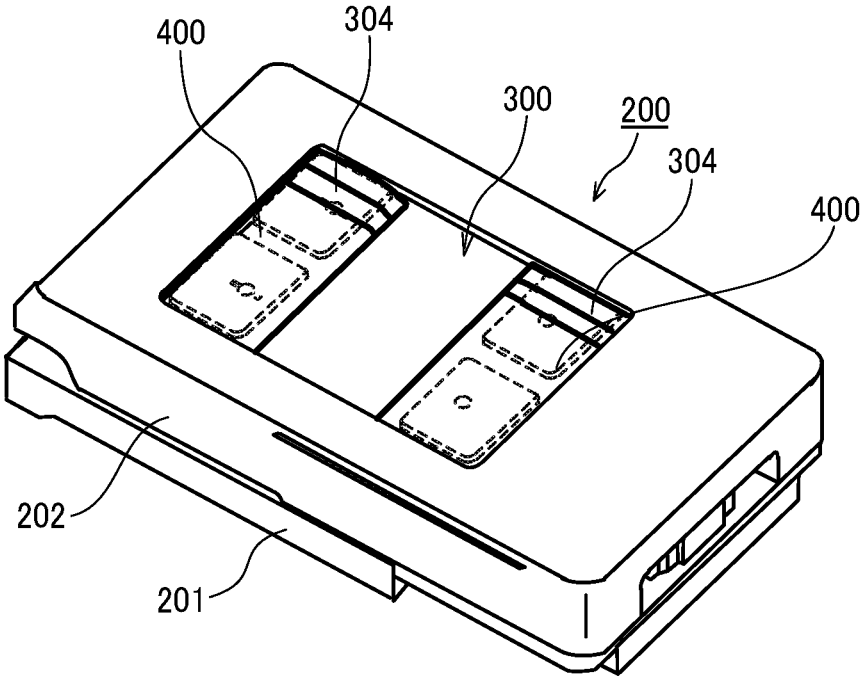
FIG. 9 is a perspective view of the cassette with the socks set therein.

When the outer cover 202 of the cassette 200 is closed as illustrated in FIG. 9, as illustrated in FIG. 7, the flange portion 300*a* of the platen 300 and the frame portion 202*b* of the outer cover 202 sandwich three sides of each sock 400 and secure the socks 400.

At this time, the portion (the surplus portion 400*a*) of the sock 400 that is outside the print area is accommodated in the accommodation space 312 as illustrated in FIG. 7.

On the other hand, the surplus portion 400*b* of the sock 400 on the center side of the platen 300 is not pinched by the outer cover 202. However, the three sides of the sock 400 are pinched by the flange portion 300*a* and the outer cover 202, and tension is generated in the direction orthogonal to the insertion and removal direction. Accordingly, as illustrated in FIG. 7, the surplus portion 400*b* enters the recess 305 with warp of an end portion inhibited.

Thus, the sock 400 smaller than the platen 300 can be reliably held flat, and printing can be reliably performed without interference with the head.

Figure 10:
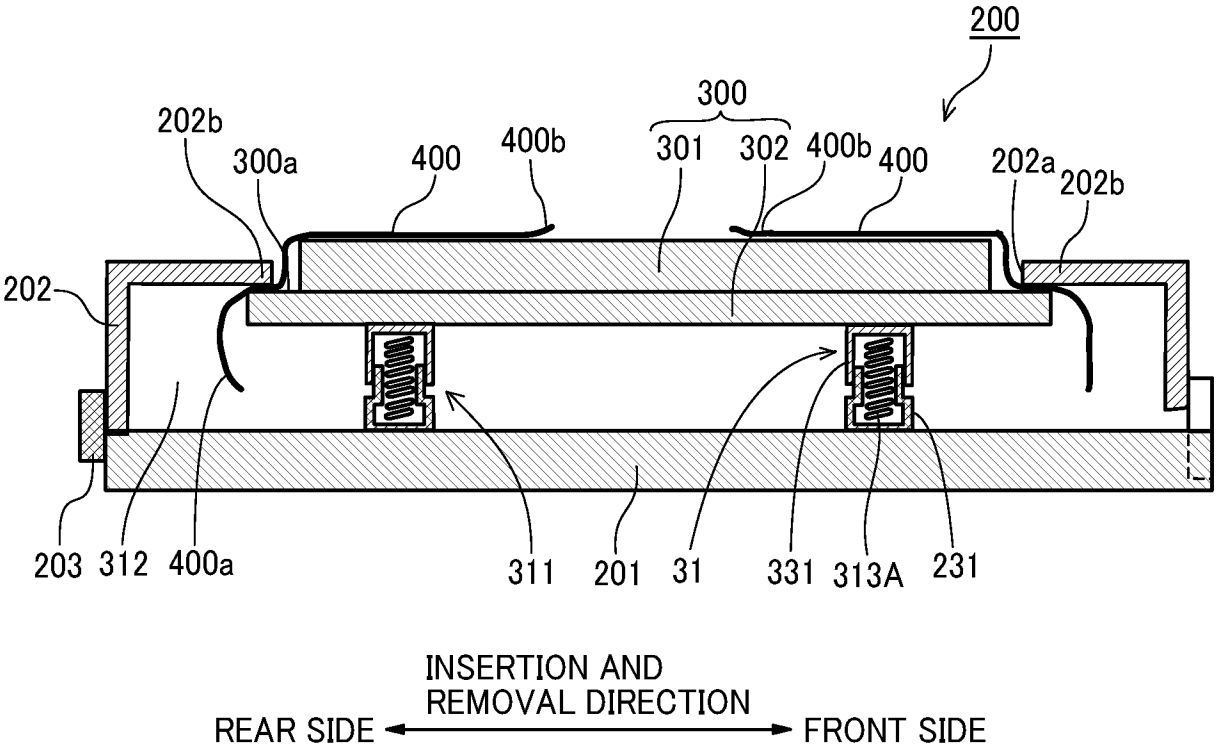
FIG. 10 is a schematic cross-sectional view of a cassette of a comparative example.

Below, a comparative example is described with reference to FIG. 10. FIG. 10 is a cross-sectional view of a cassette according to the comparative example, along the insertion and removal direction.

In the comparative example, the entire top face of the platen 300 is flat as a support face.

When the sock 400 is held in the cassette 200 according to the comparative example, the surplus portion 400*b* on the center side of the platen 300 is not pinched by the outer cover 202. In this case, the surplus portion 400*b* may follow the platen 300 but can warp in some cases as illustrated in FIG. 10.

In the case where the surplus portion 400*b* of the sock 400 warps, reliable printing is difficult. For example, the surplus portion 400*b* of the sock 400 interferes with the head.

By contrast, in the cassette 200 according to the present embodiment, even a printing target (here, the sock 400) smaller than the platen 300 can be reliably held flat, and reliable printing can be performed.

Figure 11A:
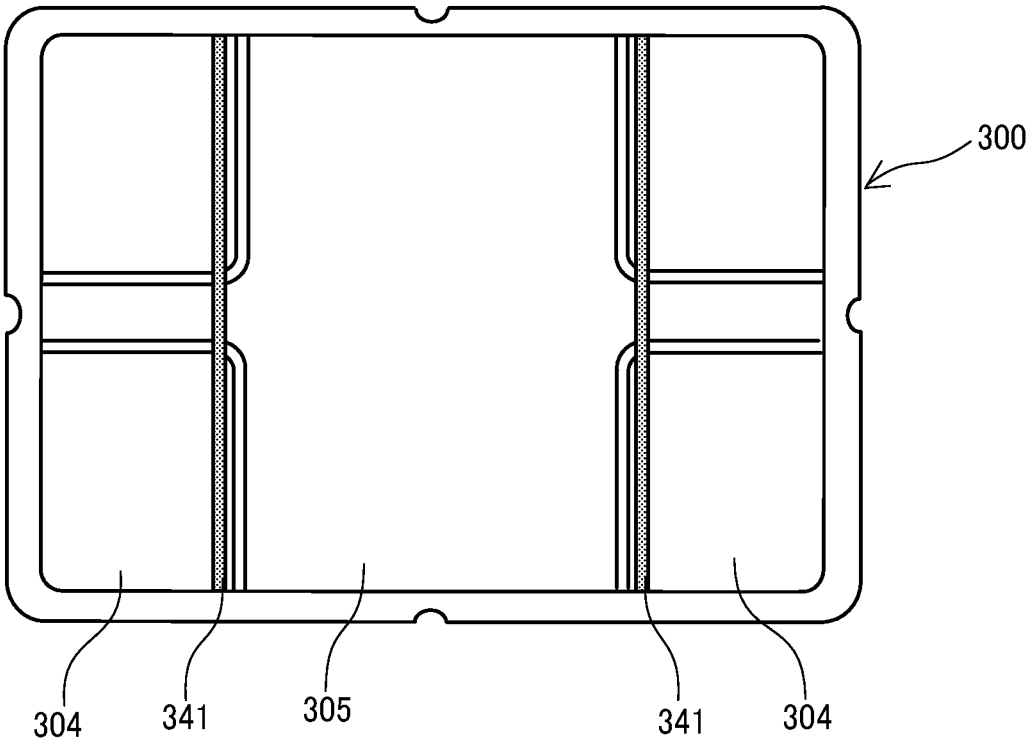
FIGS. 11A and 11B are views illustrating a platen of a cassette as a first example of Embodiment 2 of the present disclosure.
Figure 11B:
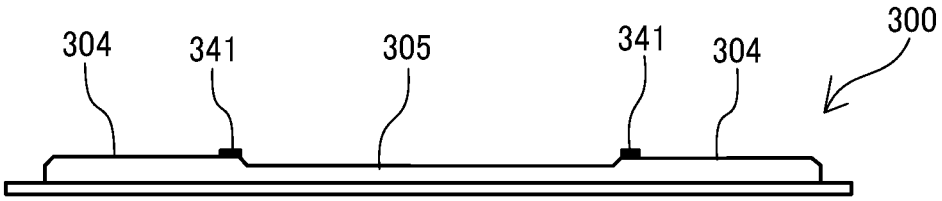
Figure 12A:
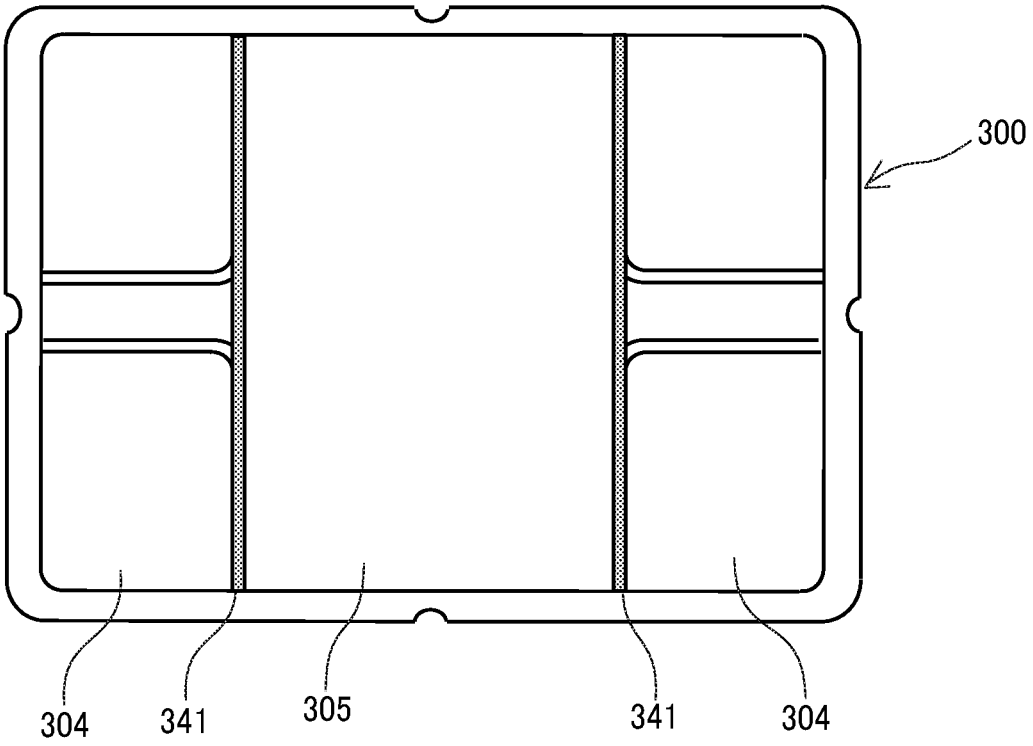
FIGS. 12A and 12B are views illustrating a platen of a cassette as a second example of Embodiment 2.
Figure 12B:
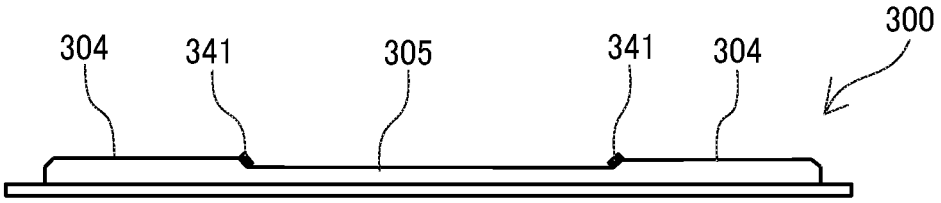
Figure 13A:
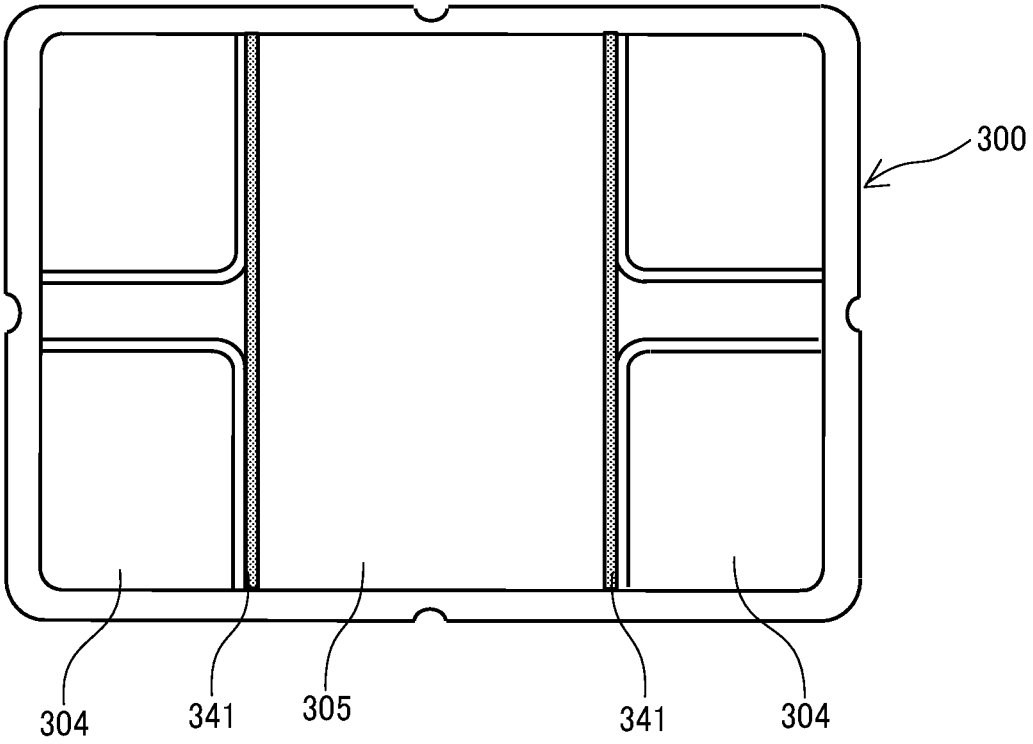
FIGS. 13A and 13B are views illustrating a platen of a cassette as a third example of Embodiment 2.
Figure 13B:
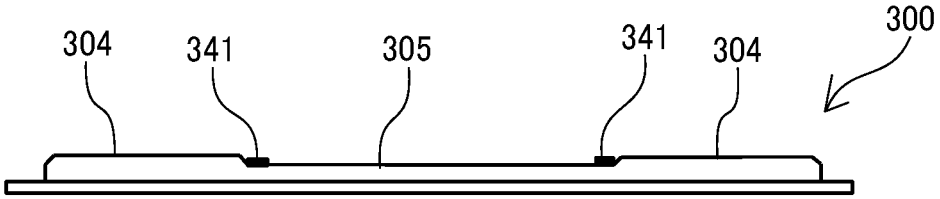

Next, descriptions are given below of different examples of the cassette (the printing target holder) according to Embodiment 2, with reference to FIGS. 11A to 13B. FIGS. 11A, 12A, and 13A are plan views illustrating platens of the different cassettes. FIGS. 11B, 12B, and 13B are side views of the platens illustrated in FIGS. 11A, 12A, and 13A, respectively.

In the present embodiment, the platen 300 includes line-shaped marks (hereinafter referred to as "boundary marks 341" indicating the boundaries between the projecting portions 304 and the recess 305 in Embodiment 1. The boundary mark 341 extends in the direction orthogonal to the insertion and removal direction of the platen 300.

In the first example illustrated in FIGS. 11A and 11B, the boundary mark 341 is provided on the projecting portions 304. In the second example illustrated in FIGS. 12A and 12B, the boundary mark 341 is provided at the step portion between the projecting portions 304 and the recess 305. In the third example illustrated in FIGS. 13A and 13B, the boundary mark 341 is provided on the recess 305.

Providing a mark (the boundary mark 341) indicating the boundary between the projecting portion 304 and the recess 305 can facilitate visual recognition of the boundary of the surface unevenness, and the region in which the sock 400 is to be set can be easily recognized.

When the difference in height between the projecting portion 304 and the recess 305 is small, finding the position to place the printing target becomes difficult. Therefore, by providing the mark to make the boundary easily recognizable, the setting becomes easy.

Figure 14:
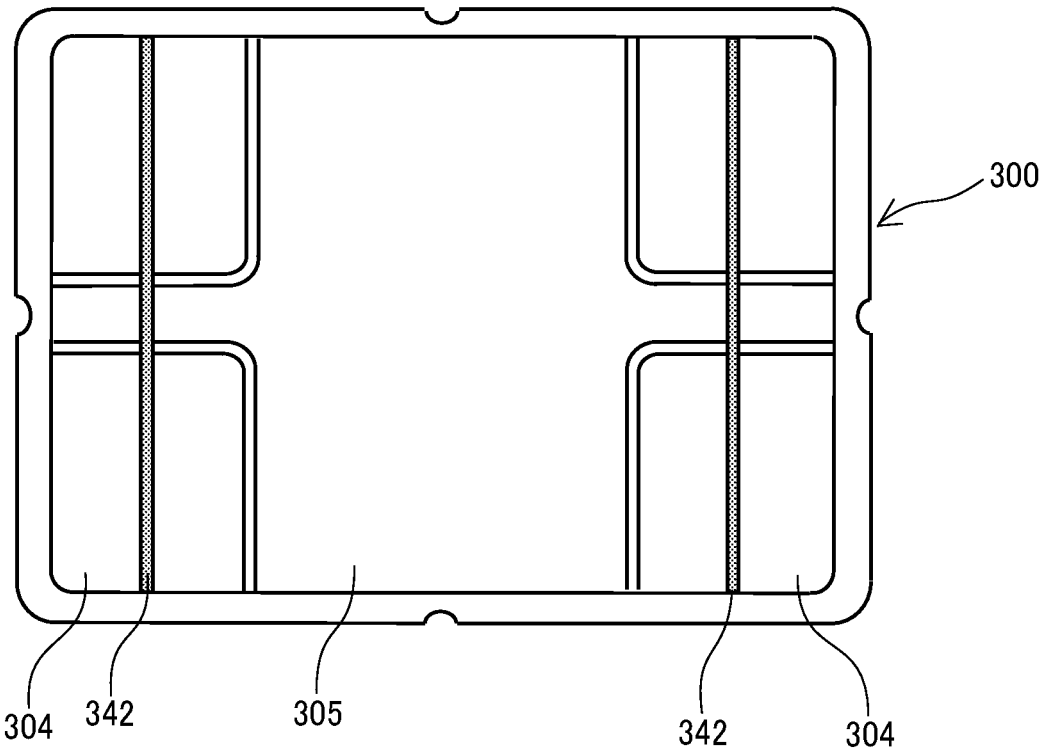
FIG. 14 is a plan view illustrating a platen of a cassette according to Embodiment 3 of the present disclosure.
Figure 15A:
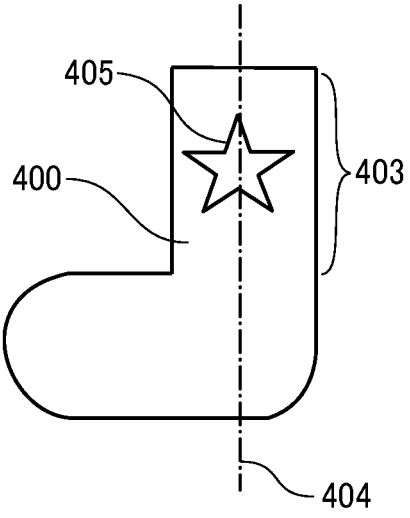
FIGS. 15A and 15B are diagrams illustrating an effect of the cassette according to Embodiment 3.
Figure 15B:
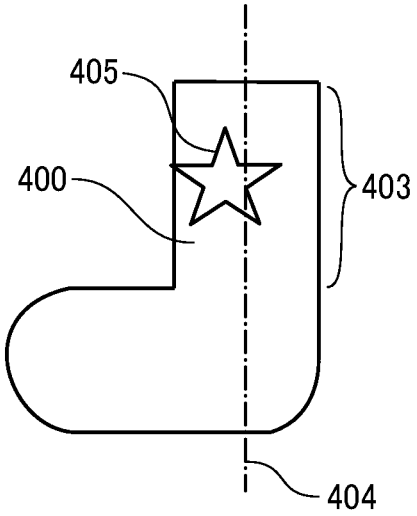
Figure 16A:
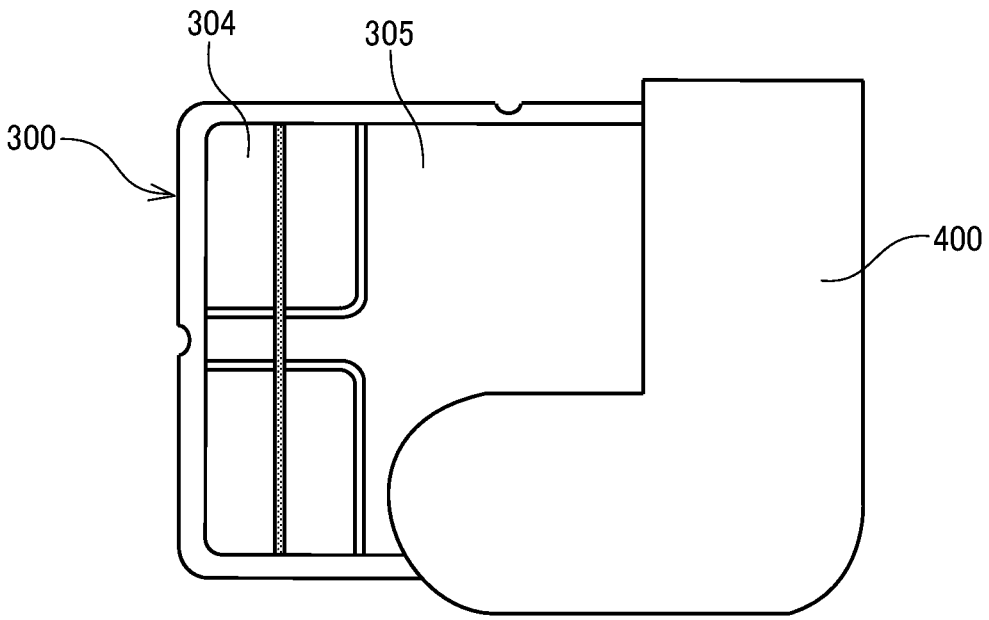
FIGS. 16A and 16B are diagrams illustrating an effect in setting a sock in the cassette according to Embodiment 3.
Figure 16B:
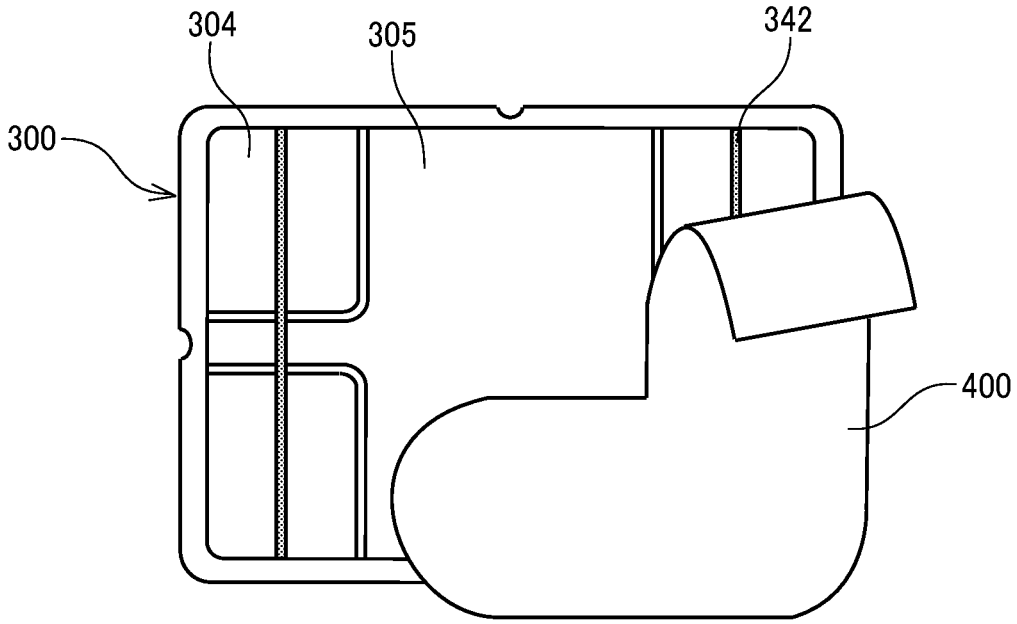

Next, descriptions are given below of an example of a cassette as a printing target holder according to Embodiment 3 of the present disclosure, with reference to FIG. 14 to FIG. 16B. FIG. 14 is a plan view illustrating a platen of the cassette according to Embodiment 3. FIGS. 15A and 15B are diagrams illustrating a deviation from a target print position. FIGS. 16A and 16B are diagrams illustrating setting of a sock on the platen according to Embodiment 3.

In the present embodiment, a line-shaped mark 342 (a center mark, illustrated in FIG. 14) is provided at the center of the projecting portion 304 of the platen 300 in the insertion and removal direction.

For example, as illustrated in FIG. 15A, a user intends to apply an image 405 to a center part (indicated by a center line 404) of a leg portion 403 of the sock 400, but the image position may deviate as illustrated in FIG. 15B, depending on the setting of the sock 400.

In view of the foregoing, providing the mark 342 in the center portion of the projecting portion 304 of the platen 300 is advantageous as follows. After placing the sock 400 on the projecting portions 304 as illustrated in FIG. 16A, the user can fold back a portion of the sock 400 (specifically, the above-mentioned leg portion 403) as illustrated in FIG. 16B, to perform alignment.

With this configuration, the sock can be easily set so that the printing is applied to the target position (in the present embodiment, the center position).

Figure 17:
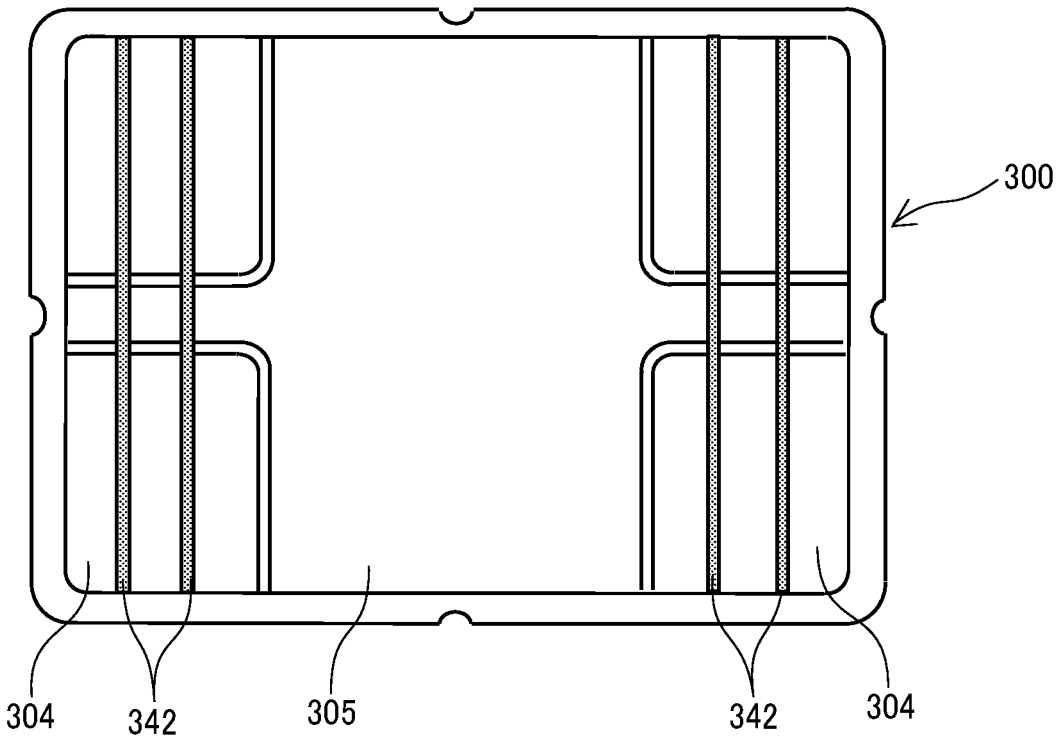
FIG. 17 is a plan view illustrating a platen of a cassette according to Embodiment 4 of the present disclosure.

Next, another configuration of the cassette as the printing target holder according to Embodiment 3 of the present disclosure will be described with reference to FIG. 17. FIG. 17 is a plan view of an example of the platen of the cassette according to Embodiment 3.

In the example illustrated in FIG. 17, the projecting portions 304 of the platen 300 are provided with marks 343 (division marks) which divide the projecting portions 304 into substantially equal portions.

Providing such division marks also facilitates setting of the sock as a printing target at the target position.

Figure 18:
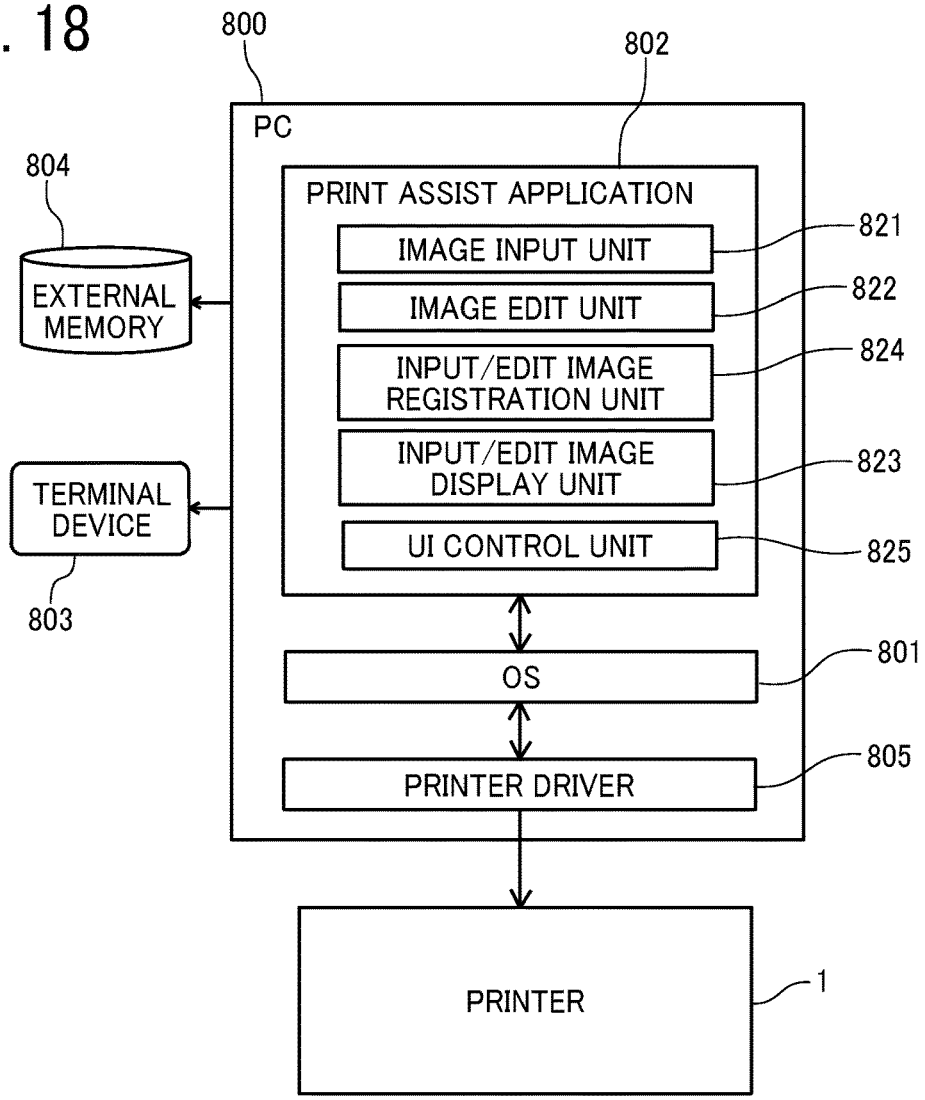
FIG. 18 is a block diagram illustrating an information processing apparatus including a program according to an embodiment of the present disclosure.

Next, an information processing apparatus including a program according to the present disclosure will be described with reference to FIG. 18. FIG. 18 is a block diagram of the information processing apparatus.

An information processing apparatus 800 is, for example, a personal computer (PC). The information processing apparatus 800 includes a print assist application 802 including a program which, when executed by, e.g., an operating system (OS) 801, causes the OS 801 to perform the following method.

The print assist application 802 aims to assist printing by the printer 1 connected to the information processing apparatus 800. With an image input unit 821, the print assist application 802 loads an image to be printed (i.e., a print image) from an image file recorded in a terminal device 803 connected to the information processing apparatus 800, an external memory 804, or an internal memory of the information processing apparatus 800.

Then, with an image edit unit 822, the print assist application 802 performs image editing such as adjustment of position, brightness, and density, rotation of the image, and cutting of the image. With an input/edit image display unit 823, the print assist application 802 displays the result of image editing. Further, the print assist application 802 stores the input image and the edited image in the input/edit image registration unit 824. The print assist application 802 further includes a user interface (UI) control unit 825 that enables input image selection, editing operation, and image registration on the application.

The format of the print image determined by the above control operation is converted into a print data format via a printer driver 805 and transferred to the printer 1.

Figure 19A:
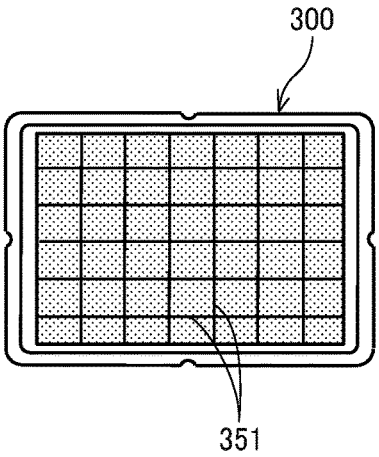
FIGS. 19A, 19B, and 19C are plan views of platens of different cassettes according to embodiments.
Figure 19B:
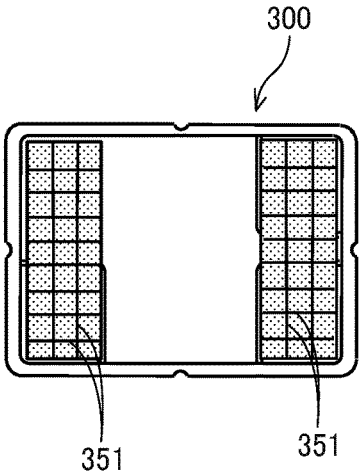
Figure 19C:
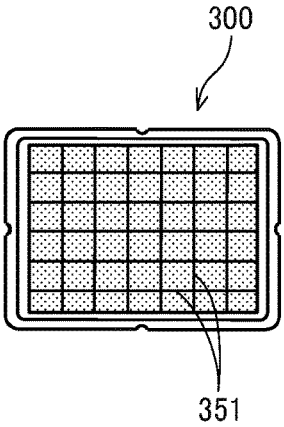

Next, different examples of the cassette usable in the printer 1 will be described with reference to FIGS. 19A to 19C. FIGS. 19A, 19B, and 19C are plan views of platens of different cassettes according to embodiments.

FIG. 19A illustrates, for example, an A4 size cassette, FIG. 19B illustrates a cassette for socks, and FIG. 19C illustrates an A5 size cassette. In each of the cassettes 200 illustrated in FIGS. 19A to 19C, grid lines 351 are provided as indications for the printing target setting position.

Figure 20:
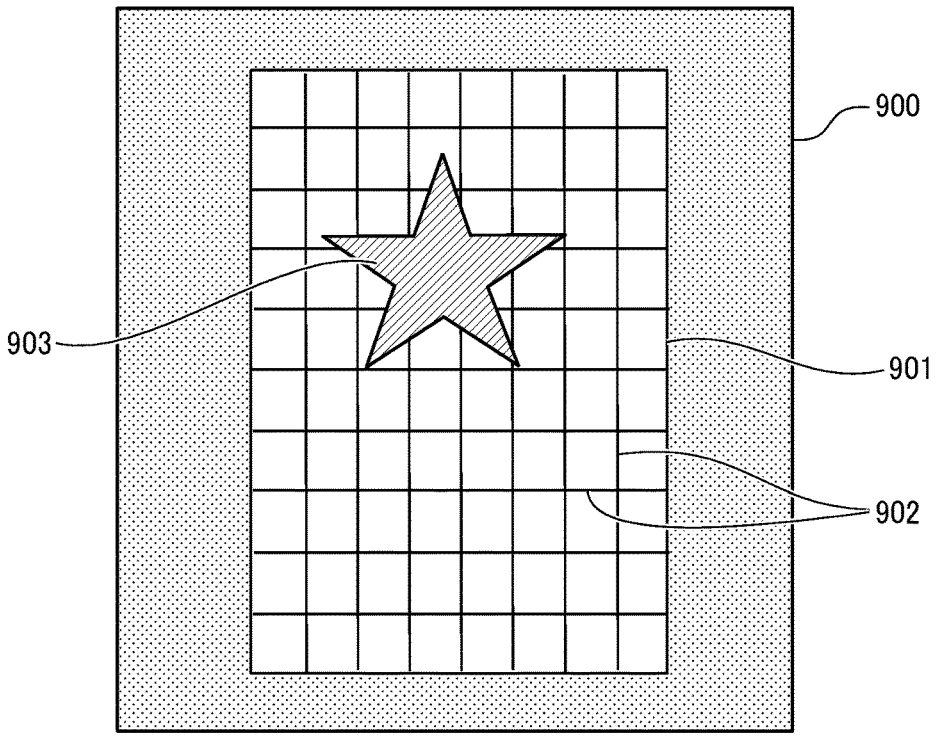
FIG. 20 is an explanatory diagram of a display example of the platen illustrated in FIG. 19A on an image editing screen.
Figure 21:
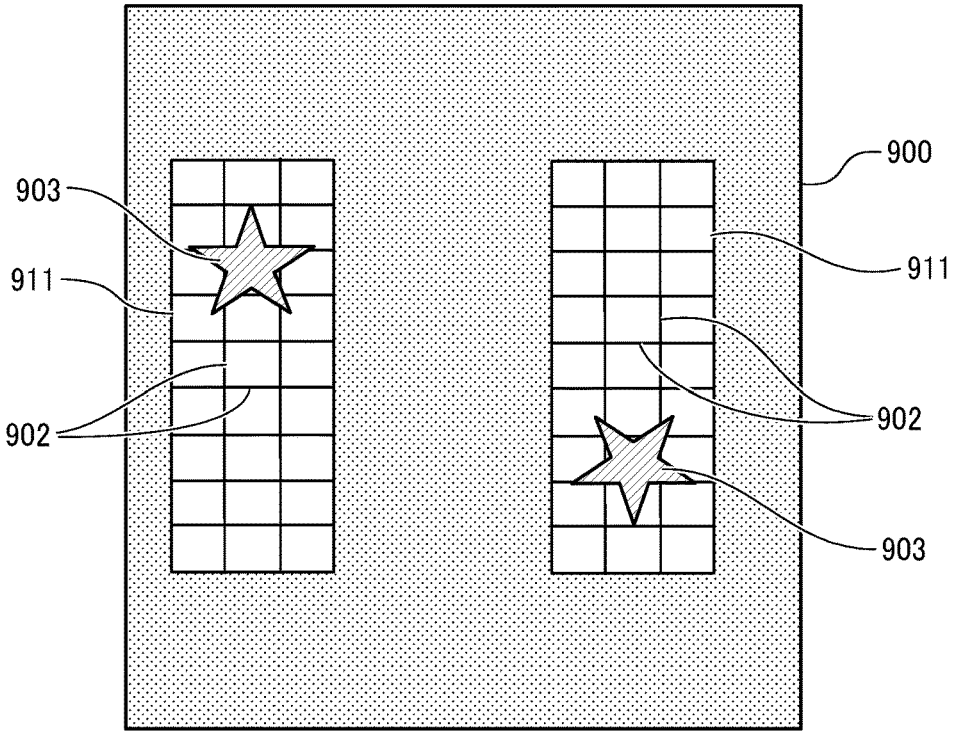
FIG. 21 is an explanatory diagram of a display example of the platen illustrated in FIG. 19B on an image editing screen.
Figure 22:
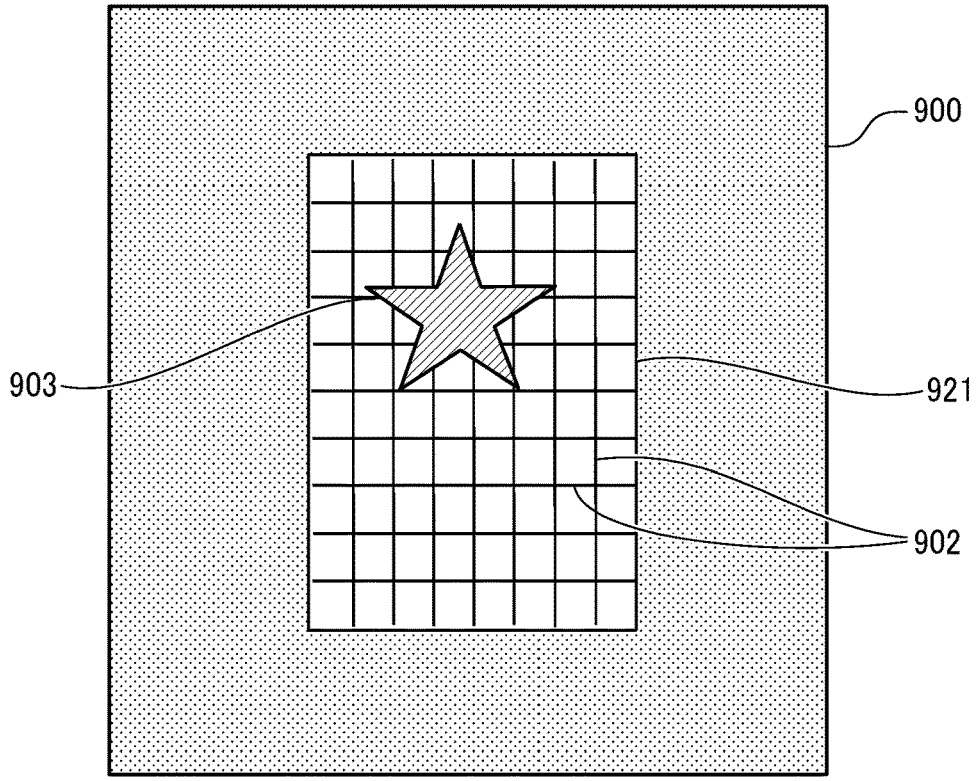
FIG. 22 is an explanatory diagram of a display example of the platen illustrated in FIG. 19C on an image editing screen.

Next, an editing screen by the print assist application will be described with reference to FIGS. 20 to 22. FIGS. 20 to 22 illustrate editing screens 900. FIGS. 20 to 22 illustrate only a display area of the cassette as the editing screen 900.

FIG. 20 illustrates an example of the editing screen when using the A4 size cassette. In FIG. 20, the editing screen 900 displays an image of a printing area 901 corresponding to the platen 300 of the A4 size cassette 200, together with lines 902 corresponding to the grid lines 351.

FIG. 21 illustrates an example of the editing screen when using the cassette for socks. In FIG. 21, the editing screen 900 displays images of two printing areas 911 corresponding to the projecting portions 304 of the platen 300 of the cassette 200 for socks, together with lines 902 corresponding to the grid lines 351.

FIG. 22 illustrates an example of the editing screen when using the A5 size cassette. In FIG. 22, the editing screen 900 displays an image of a printing area 921 corresponding to the platen 300 of the A5 size cassette 200, together with lines 902 corresponding to the grid lines 351.

In each of these display examples, the printing areas 901, 911, and 921 are displayed, for example, in gray to distinguish the printing areas 901, 911, and 921 from the remaining area of the platen 300.

As the editing screen 900 provides a preview of the image 903 to be printed in the printing areas 901, 911, and 921, the actual image position can be confirmed on the editing screen 900.

Thus, on the editing screen 900 of the print assist application 802, the printing area and grid lines are displayed corresponding to the cassette 200 (the support face of the platen 300) used and the grid lines 351 of the printing target support area (printable area) of the cassette 200.

As a result, positioning and editing of the print image can be performed more properly in accordance with the actual shape and set position of the cassette 200.

The lines displayed on the editing screen 900 are not limited to the above example. For example, the number of the lines or the presence or absence of the lines may be changed according to the purpose. Further, those settings may be controlled by the UI control unit 825 of the print assist application 802.

Figure 23:
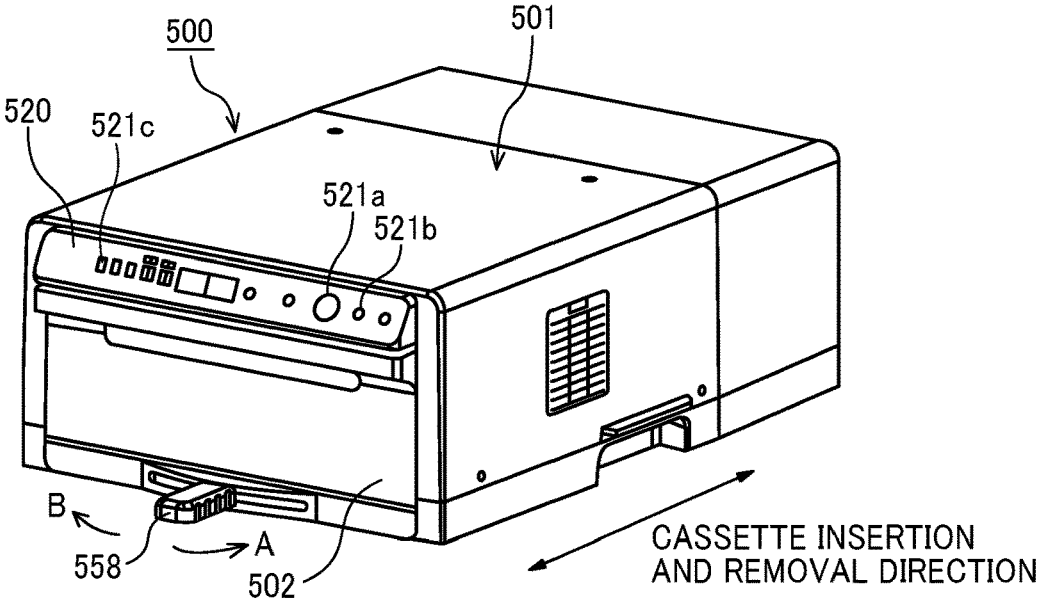
FIG. 23 is an exterior perspective view of an example of the heater.
Figure 24:
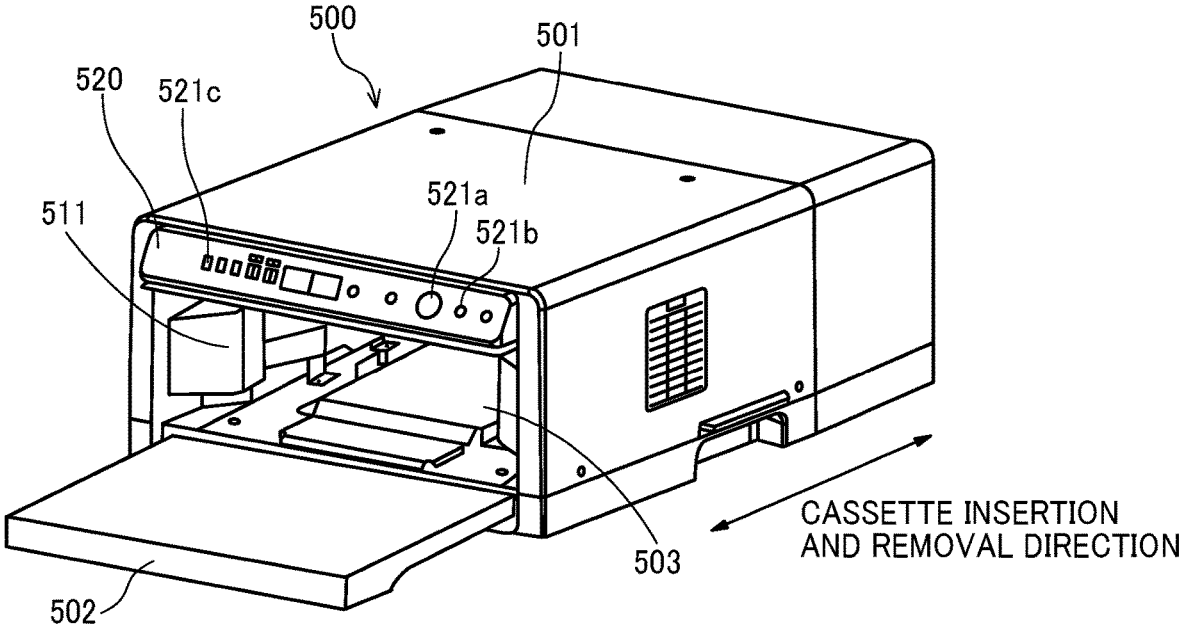
FIG. 24 is a perspective view of the heater illustrated in FIG. 23, in which a front door of the heater is opened.
Figure 25:
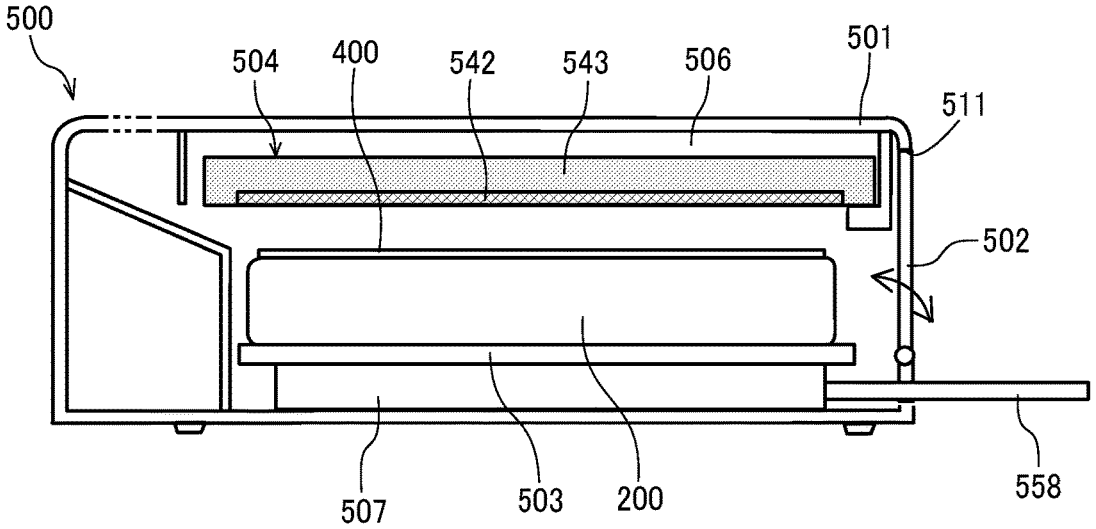
FIG. 25 is a schematic cross-sectional view of the heater illustrated in FIG. 24, cut along the longitudinal direction of the heater (cassette insertion/removal direction).

Next, an example of the heater will be described with reference to FIGS. 23 to 25. FIG. 23 is an exterior perspective view of the heater according to an embodiment. FIG. 24 is a perspective view of the heater in a state in which a front door of the heater is opened. FIG. is a schematic cross-sectional view of the heater cut along the longitudinal direction of the heater (cassette insertion/removal direction).

The heater 500 includes a heater body 501, and a front door 502 (a front cover) provided on the front side of the heater body 501. The front door 502 opens and closes an opening 511 of the heater body 501 for taking in and out the cassette 200.

The front door 502 is openable and closable. By opening the front door 502, the cassette 200 holding the sock 400 to be heated (the printing target) can be taken in and out of the heater body 501 through the opening 511.

A receiving mount 503 (e.g., a table) is disposed inside the heater body 501. The receiving mount 503 holds the cassette 200 removably from the heater body 501. As described above, the cassette 200 is a printing target holder to removably hold the socks 400. Similarly to the stage 111 of the printer 1 illustrated in FIG. 2, the receiving mount 503 can be a member that supports the cassette 200 removably attached thereto, a table that supports the cassette 200 placed thereon, or the like. The receiving mount 503 is a table in this example.

A heating element 504 to heat the sock 400 held in the cassette 200 is disposed above the receiving mount 503.

The heating element 504 includes a heating element 542 opposed to the sock 400 held in the cassette 200 and a heat insulator 543 to thermally insulate the heat from the heating element 542 to the side opposite to the receiving mount 503. A space 506 is secured between the heat insulator 543 and the inner wall surface of the heater body 501.

The surface of the heating element 542 facing the receiving mount 503 is substantially parallel to the exposed surface of the sock 400 held in the cassette 200 set in the heater body 501.

For example, a planar member made of a material having excellent heat conductivity, such as aluminum, can be disposed on the receiving mount 503 side of the heating element 504, so that the surface temperature thereof is uniformly raised by the heating element 542. Such a configuration enables heating of the sock 400 at substantially even temperature in the plane, regardless of the heating position of the heating element 542.

The receiving mount 503 is held by a lift 507 (position switching mechanism). The receiving mount 503 is movable in three steps in the vertical direction (a direction in which the relative distance changes) relative to the heating element 504.

The receiving mount 503 can be moved up and down as a control lever 558 of the lift 507 is set at a neutral position illustrated in FIG. 23 and moved in the directions indicated by arrows A and B in FIG. 23.

The three positions of the receiving mount 503 relative to the heating element 504 is described. When the control lever 558 is at the neutral position, the receiving mount 503 is at a standby position (a first position). When the control lever 558 is turned in the direction indicated by arrow A, the receiving mount 503 moves to a contactless heating position (a second position). When the control lever 558 is turned in the direction indicated by arrow B, the receiving mount 503 moves to a contact heating position (a third position).

In addition, a control panel 520 includes a self-illuminating preheating start key 521*a* (a preheating start button) for instructing start of preheating, a stop key 521*b* for instructing stopping of the heating, and a heating indicator 521*c* to indicate that heating is ongoing.

Although the above-described embodiments concern the case where the printing target is cloth, in particular, a sock, the printing target is not limited thereto. Aspects of the present disclosure can be similarly applied to a case of setting cloth other than a sock on a platen or a case of setting a printing target other than cloth on the platen.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

What is claimed is:

1. A printing target holder comprising a platen configured to hold a printing target portion of a printing target in a flat state, and to hold a non-printing target portion of the printing target in a recessed state relative to the flat state, the printing target portion to which printing is applied, and the non-printing target portion to which printing is not applied, the platen including:

a support face disposed on a top side of the platen, the support face configured to support the printing target portion of the printing target; and an escape portion disposed on the top side of the platen that is lower in height than, and recessed in, the support face, the escape portion configured to recess the non-printing target portion of the printing target.

2. The printing target holder according to claim 1, further comprising an outer cover configured to sandwich the printing target with a periphery portion of the platen.

3. The printing target holder according to claim 1, wherein the support face is disposed at an end of the platen.

4. The printing target holder according to claim 1, further comprising a mark indicating a boundary between the support face and the escape portion.

5. The printing target holder according to claim 4, wherein the mark indicating the boundary is on one of the support face, the escape portion, and a step between the support face and the escape portion.

6. The printing target holder according to claim 4, further comprising a line-shaped mark disposed in a center portion of the support face.

7. The printing target holder according to claim 1, further comprising a line-shaped mark disposed on the support face, the line-shaped mark dividing the support face into equal portions.

8. A printer comprising:

a mount on which the printing target holder according to claim 1 is removably mounted; and a printing device configured to print an image on the printing target held by the printing target holder mounted on the mount.

9. A heater comprising:

a mount on which the printing target holder according to claim 1 is to be removably mounted; and a heating element configured to heat the printing target held by the printing target holder.

10. An image forming system comprising:

the printing target holder according to claim 1;

a printer including:

a mount on which the printing target holder is removably mounted; and a printing device configured to print an image on the printing target held by the printing target holder mounted on the mount; and a heater including:

a mount on which the printing target holder is to be removably mounted; and a heating element configured to heat the printing target held by the printing target holder.

11. A non-transitory recording medium storing a plurality of program codes which, when executed by one or more processors, causes the processors to perform a method, the method comprising:

displaying, on a screen, a preview of an image to be printed on a printing target held by the printing target holder according to claim 1; and distinguishing, on the screen, an area of the support face of the platen from a remaining area of the platen.

12. The non-transitory recording medium according to claim 11, wherein the method further comprises displaying a line corresponding to a grid line disposed on the platen in a manner overlapping with the area of the support face.

13. The printing target holder of claim 1, further comprising:

an outer cover, wherein the escape portion is on the support face of the platen and in an area surrounded by the outer cover.

* * * * *